US005156905A

United States Patent [19]

Bagrodia et al.

[11] Patent Number: 5,156,905

[45] Date of Patent: Oct. 20, 1992

[54] SHAPED ARTICLES FROM MELT-BLOWN, ORIENTED FIBERS OF POLYMERS CONTAINING MICROBEADS

[75] Inventors: Shriram Bagrodia, Kingsport; Mark A. Pollock, Johnson City, both of Tenn.

[73] Assignee: Eastman Kodak Company, Rochester, N.Y.

[21] Appl. No.: 620,949

[22] Filed: Dec. 3, 1990

[51] Int. Cl.[5] ..... B32B 3/26; B32B 5/24; D04H 1/58; D02G 3/00

[52] U.S. Cl. ..... 428/224; 428/288; 428/296; 428/311.1; 428/311.5; 428/372; 428/376; 428/398; 156/62.4

[58] Field of Search ..... 428/224, 288, 372, 376, 428/398, 224, 296, 311.1, 311.5; 156/62.4

[56] References Cited

U.S. PATENT DOCUMENTS

| | | | |
|---|---|---|---|
| 2,465,319 | 3/1949 | Whinfield et al. | 260/75 |
| 2,901,466 | 8/1959 | Kibler et al. | 260/75 |
| 3,154,461 | 10/1964 | Johnson | 161/116 |
| 3,640,944 | 2/1972 | Seppala et al. | 260/40 |
| 3,944,699 | 3/1976 | Mathews et al. | 428/220 |
| 4,320,207 | 3/1982 | Watanabe et al. | 521/54 |
| 4,377,616 | 3/1983 | Ashcraft et al. | 428/213 |
| 4,770,931 | 9/1988 | Pollock et al. | 428/304.4 |
| 4,780,402 | 10/1988 | Remmington | 430/533 |
| 4,942,005 | 7/1990 | Pollock et al. | 264/45.3 |

OTHER PUBLICATIONS

U.S. Ser. No. 625,383 "Shaped Articles from Orientable Polymers and Polymer Microbeads" filed by Maier et al. on Dec. 11, 1990.

*Primary Examiner*—George F. Lesmes
*Assistant Examiner*—Kathryne E. Shelborne
*Attorney, Agent, or Firm*—John F. Stevens; William P. Heath, Jr.

[57] ABSTRACT

Disclosed are molded articles comprising a melt blown assembly of thermally bonded, longitudinally oriented fibers, said fibers comprising a continuous polymer matrix having dispersed therein microbeads of a material which is incompatible with said polymer matrix which are at least partially bordered by void space, said microbeads being present in an amount of about 5–50% by weight based on the weight of polymer matrix, said void space occupying about 2–60% by volume of said fibers.

10 Claims, 2 Drawing Sheets

SHAPED ARTICLES FROM MELT-BLOWN, ORIENTED FIBERS OF POLYMERS CONTAINING MICROBEADS

TECHNICAL FIELD

The present invention is directed to molded articles from melt-blown, oriented fibers of polymers containing microbeads. These fibers have an oriented polymer continuous phase and microbeads dispersed therein which are at least partially bordered by voids. The articles have unique properties of texture, opaqueness and low density. Thermoforming is a preferred way of forming the shaped articles.

BACKGROUND OF THE INVENTION

Blends of polyesters with incompatible materials to form microvoided structures are well-known in the art. U.S. Pat. No. 3,154,461 discloses, for example, linear polyesters blended with, for example, calcium carbonate. U.S. Pat. No. 3,944,699 discloses blends of linear polyesters with organic material such as ethylene or propylene polymer. U.S. Pat. No. 3,640,944 discloses poly(ethylene terephthalate) blended with organic material such as polysulfone or poly(4-methyl-1-pentene). U.S. Pat. No. 4,377,616 discloses a blend of polypropylene to serve as a matrix with a small percentage of another incompatible organic material, nylon, to initiate microvoiding in the polypropylene matrix. U.K. patent specification No. 1,563,591 discloses polyesters for making opaque thermoplastic film support in which have been blended finely divided particles of barium sulfate together with a void-promoting polyolefin.

The above-mentioned patents show that it is known to use incompatible blends to form films having paper-like characteristics after such blends have been extruded into films and the films have been quenched, biaxially oriented and heat set. The minor component of the blend, due to its incompatibility with the major component, upon melt extrusion into film forms generally spherical particles each of which initiates a microvoid in the resulting matrix formed by the major component. The melting points of the void initiating particles, in the use of organic materials, should be above the glass transition temperature of the major component of the blend and particularly at the temperature of biaxial orientation.

As indicated in U.S. Pat. No. 4,377,616, spherical particles initiate voids of unusual regularity and orientation in a stratified relationship throughout the matrix material after biaxial orientation of the extruded film.

The voids generally tend to be closed cells, and thus there is virtually no path open from one side of a biaxially oriented film to the other side through which liquid or gas can traverse. The term "void" is used herein to mean devoid of solid matter, although it is likely the "voids" contain a gas.

Upon orientation of spun fibers, they become white and opaque, the opacity resulting from light being scattered from the walls of the microvoids. The transmission of light becomes lessened with increased number and size of the microvoids relative to the size of a particle within each microvoid.

Also, upon biaxial orientation, a matte finish on the surface of film results, as discussed in U.S. Pat. No. 3,154,461. The particles adjacent the surfaces of the film tend to be incompressible and thus form projections without rupturing the surface.

Of particular interest are U.S. Pat. Nos. 4,770,931 and 4,942,005 which are directed to articles comprising a continuous polyester phase having dispersed therein microbeads of cellulose acetate which are at least partially bordered by void space. Also, the compositions of this invention have superior thermal and chemical stability, when compared with the prior art, especially the cellulose esters. Also, of particular interest is U.S. Pat. No. 4,320,207 which discloses oriented polyester film containing pulverized cross-linked polymers. Furthermore, it is known that fibers of the composition of the present invention may be melt blown to form nonwoven, spun-bonded products.

DESCRIPTION OF THE INVENTION

In accordance with the present invention, shaped articles are provided which have unique properties such as texture, opacity, low density, etc. The articles are especially useful when in the form of sheet material or a tube, and may be further processed by techniques well known in the art such as thermoforming.

According to the present invention, there is provided a molded article comprising a melt-blown assembly of thermally bonded, longitudinally oriented fibers, said fibers comprising a continuous polymer matrix having dispersed therein microbeads of a material which is incompatible with said polymer matrix which are at least partially bordered by void space, said microbeads being present in an amount of about 5–50% by weight based on the weight of polymer matrix, said void space occupying about 2–60% by volume of said fibers. Melt-blowing is a process in which high velocity air blows molten thermoplastic resin from an extruder die tip on to a conveyor or take up screen to form fine-fiber web. These webs, melt-blown nonwoven fabrics, have good hand, moderate strength and a wide variety of end uses. In the present invention, melt-blown fibers from fiber forming polymers containing polymer microbeads are formed into shaped articles. The presence of these microbeads in the polymer matrix, creates microvoids in these melt-blown fibers, producing structures with low density; and these structures are opaque, white, with a unique hand and surface texture.

The molded articles according to this invention are prepared by (a) forming a mixture of molten continuous matrix polymer and microbeads uniformly dispersed throughout the matrix polymer, the matrix polymer being as described hereinbefore, the microbeads being as described hereinbefore, (b) forming a thermally bonded fiber assembly from the mixture by melt-blowing onto a support, and thereby attenuating and orienting the fibers to form voids at least partially bordering the microbeads on sides thereof in the direction of orientation, and (c) molding articles into the desired shape.

The shaped article is processed by thermo-forming or otherwise molding into a desired shape using conventional techniques.

The mixture may be formed by forming a melt of the matrix polymer and mixing therein the microbeads. The microbeads may be in the form of solid or semi-solid microbeads. Due to the incompatibility between the matrix polymer and microbeads, there is no attraction or adhesion between them, and they become uniformly dispersed in the matrix polymer upon mixing.

Figure 1:
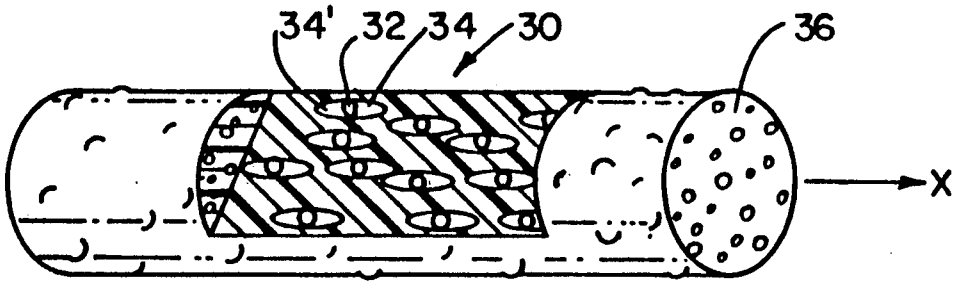
FIG. 1 is a perspective view in section illustrating oriented fibers used in forming the shaped articles of the present invention.

FIG. 1 illustrates a fiber 30 which has been oriented by stretching in the lengthwise (X) direction. The microbeads 32 of cross-linked polymer are bordered by microvoids 34 and 34'.

Figure 2:
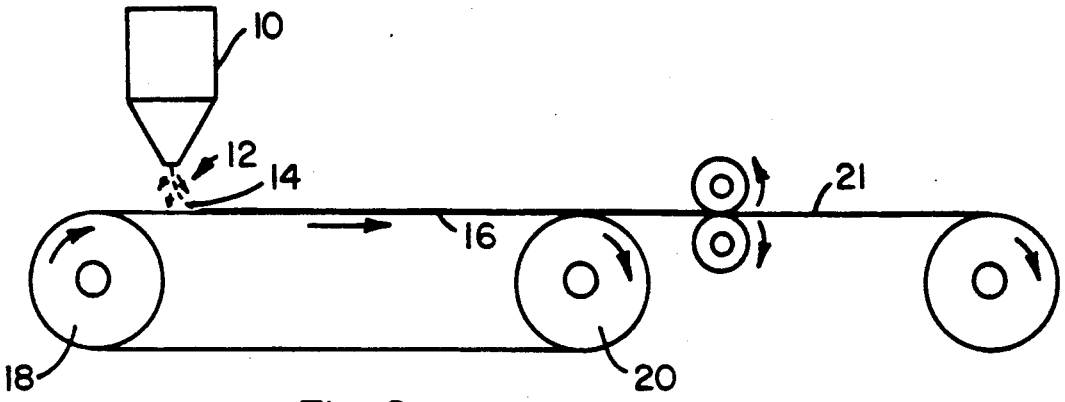
FIG. 2 is a schematic of apparatus used for melt-blowing fibers.

In a conventional melt-blowing process, the fibers are attenuated and longitudinally oriented by a flowing gas, such as air. In such processes, as generally illustrated in FIG. 2, molten thermoplastic material enters an extruder 10 and is forced therethrough. Material exits from nozzle 12 and is immediately contacted by gas at the nozzle tip being forced under pressure in the direction indicated by arrows. A plurality of nozzles suitably arranged may be used if desired. The gas may be heated, and serves to attenuate the extruded thermoplastic material into a plurality of fibers 14 and direct them to a combination collecting and/or forming device 16.

Figure 3:
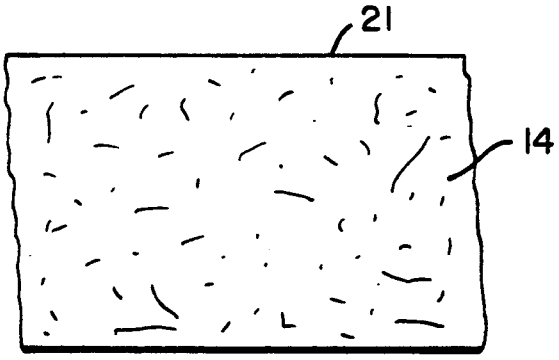
FIG. 3 is an illustration of a melt-blown sheet according to the present invention.
Figure 4:
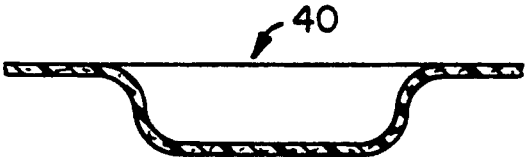
FIG. 4 is a sectional view of a molded article in accordance with this invention.

The collecting and/or forming device may be a belt or conveyor 16 entrained around driven rolls 18 and 20, whereby the fibers are collected thereon in continuous manner as the belt advances. As the fibers collect in semi-solid condition, they are thermally bonded into a sheet 21 and wound onto a roll 22. If desired, compacting rolls 24 and 26 may be used. FIG. 3 illustrates the thermally bonded fibers in a sheet. FIG. 4 illustrates a molded article 40 produced by thermoforming the sheet of FIG. 3.

An important aspect of this invention is that during melt processing the orientable polymer does not react chemically or physically with the microbead material in such a way as to cause one or more of the following to occur to a significant or unacceptable degree: (a) alteration of the crystallization kinetics of the matrix polymer making it difficult to orient, (b) destruction of the matrix polymer, (c) destruction of the microbeads, (d) adhesion of the microbeads to the matrix polymer, or (e) generation of undesirable reaction products, such as toxic or high-color moieties.

In accordance with a preferred embodiment of the present invention, the microbeads are of a cross-linked polymer, which gives them resiliency and elasticity. Second, the microbeads are preferably formed in the presence of "slip agent" to permit easier sliding with respect to the matrix polymer to thereby result in more microvoiding. Although both aspects are believed to be unique and yield improved results to an extent, it is preferred that the microbeads be both cross-linked and formed in the presence of the slip agent.

The present invention provides shaped articles comprising a continuous thermoplastic polymer phase having dispersed therein microbeads which are at least partially bordered by voids, the microbeads having a size of about 0.1–50 microns, preferably about 2–20 microns, and being present in an amount of about 5–50% by weight based on the weight of continuous phase polymer, the voids occupying about 2–60% by volume of the shaped article. The matrix polymer containing the microbeads which, according to one aspect of the invention, are cross-linked to the extent of having a resiliency or elasticity at orientation temperatures of the matrix polymer such that a generally spherical shape of the cross-linked polymer is maintained after orientation of the matrix polymer. The composition of the shaped article when consisting only of the polymer continuous phase and microbeads bordered by voids, is characterized as being opaque and having a specific gravity of less than 1.20, preferably about 0.3–1.0.

In the absence of additives or colorants, the fibers used to produce the shaped articles of this invention are very white, have a very pleasant feel or hand, and are receptive to ink. The shaped articles are very resistant to wear, moisture, oil, tearing, etc.

The melt-blown fibers are preferably thermally bonded in the form of a sheet or tube which may be subsequently thermo-formed into other useful articles if desired having a multiplicity of thicknesses depending upon the end-use application.

The continuous phase polymer may be any article-forming polymer such as a polyester capable of being cast into a film or sheet, spun into fibers, extruded into rods or extrusion, blow-molded into containers such as bottles, etc. The polyesters should have a glass transition temperature between about 50° C. and about 150° C., preferably about 60–100° C., should be orientable, and have an I.V. of at least 0.50, preferably 0.6 to 0.9. Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Polypropylene is also useful. Other suitable polyesters include liquid crystal co-polyesters formed by the inclusion of a suitable amount of a co-acid component such as stilbene dicarboxylic acid. Examples of such liquid crystal co-polyesters are those disclosed in U.S. Pat. Nos. 4,420,607, 4,459,402 and 4,468,510.

Suitable cross-linked polymers for the microbeads are polymerizable organic materials which are members selected from the group consisting of an alkenyl aromatic compound having the general formula

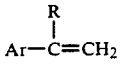

wherein Ar represents an aromatic hydrocarbon radical, or an aromatic halohydrocarbon radical of the benzene series and R is hydrogen or the methyl radical; acrylate-type monomers include monomers of the formula

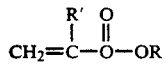

wherein R is selected from the group consisting of hydrogen and an alkyl radical containing from about 1 to 12 carbon atoms and R′ is selected from the group consisting of hydrogen and methyl; co-polymers of vinyl chloride and vinylidene chloride, acrylonitrile and vinyl chloride, vinyl bromide, vinyl esters having the formula

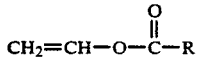

wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$, wherein n is a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent such as divinylbenzene, diethylene glycol dimethacrylate, diallyl phthalate and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening to produce beads spanning the range of the original distribution of sizes. Other processes such as suspension polymerization, limited coalescence, directly yield very uniformly sized particles.

Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred. As the slip agent, colloidal silica is preferred.

It is preferred to use the "limited coalescence"technique for producing the coated, cross-linked polymer microbeads. This process is described in detail in U.S. Pat. No. 3,615,972, incorporated herein by reference. Preparation of the coated microbeads for use in the present invention does not utilize a blowing agent as described in this patent, however.

The following general procedure may be utilized in a limited coalescence technique.

1. The polymerizable liquid is dispersed within an aqueous non-solvent liquid medium to form a dispersion of droplets having sizes hot larger than the size desired for the polymer globules, whereupon
2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and
3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and
4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid, and hence the diameter of the beads of polymer, can be varied predictably, by deliberate variation of the composition of the aqueous liquid dispersion, within the range of from about one-half of a micron or less to about 0.5 centimeter. For any specific operation, the range of diameters of the droplets of liquid, and hence of polymer beads, has a factor in the order of three or less as contrasted to factors of 10 or more for diameters of droplets and beads prepared by usual suspension polymerization methods employing critical agitation procedures. Since the bead size, e.g., diameter, in the present method is determined principally by the composition of the aqueous dispersion, the mechanical conditions, such as the degree of agitation, the size and design of the apparatus used, and the scale of operation, are not highly critical. Furthermore, by employing the same composition, the operations can be repeated, or the scale of operations can be changed, and substantially the same results can be obtained.

The present method is carried out by dispersing one part by volume of a polymerizable liquid into at least 0.5, preferably from 0.5 to about 10 or more, parts by volume of a nonsolvent aqueous medium comprising water and at least the first of the following ingredients.

1. A water-dispersible, water-insoluble solid colloid, the particles of which, in aqueous dispersion, have dimensions in the order of from about 0.008 to about 50 microns, which particles tend to gather at the liquid-liquid interface or are caused to do so by the presence of
2. A water-soluble "promotor" that affects the "hydrophilic-hydrophobic balance" of the solid colloid particles; and/or
3. An electrolyte; and/or
4. Colloid-active modifiers such as peptizing agents, surface-active agents and the like; and, usually, 5. A water-soluble, monomer-insoluble inhibitor of polymerization.

The water-dispersible, water-insoluble solid colloids can be inorganic materials such as metal salts or hydroxides or clays, or can be organic materials such as raw starches, sulfonated cross-linked organic high polymers, resinous polymers and the like.

The solid colloidal material must be insoluble but dispersible in water and both insoluble and nondispersible in, but wettable by, the polymerizable liquid. The solid colloids must be much more hydrophilic than oleophilic so as to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size is approximately that of the swollen particle. The particles can be essentially single molecules, as in the case of extremely high molecular weight cross-linked resins, or can be aggregates of many molecules. Materials that disperse in water to form true or colloidal solutions in which the particles have a size below the range stated or in which the particles are so diffuse as to lack a discernible shape and dimension are not suitable as stabilizers for limited coalescence. The amount of solid colloid that is employed is usually such as corresponds to from about 0.01 to about 10 or more grams per 100 cubic centimeters of the polymerizable liquid.

In order to function as a stabilizer for the limited coalescence of the polymerizable liquid droplets, it is essential that the solid colloid must tend to collect with the aqueous liquid at the liquid-liquid. interface, i.e., on the surface of the oil droplets. (The term "oil" is occasionally used herein as generic to liquids that are insoluble in water.) In many instances, it is desirable to add a "promoter" material to the aqueous composition to drive the particles of the solid colloid to the liquid-liquid interface. This phenomenon is well known in the emulsion art, and is here applied to solid colloidal particles, as a expanded of adjusting the "hydrophilic-hydrophobic balance".

Usually, the promoters are organic materials that have an affinity for the solid colloid and also for the oil droplets and that are capable of making the solid colloid more oleophilic. The affinity for the oil surface is usually due to some organic portion of the promoter molecule while affinity for the solid colloid is usually due to opposite electrical charges. For example, positively charged complex metal salts or hydroxides, such as aluminum hydroxide, can be promoted by the presence of negatively charged organic promoters such as water-soluble sulfonated polystyrenes, alignates and carboxymethylcellulose. Negatively charged colloids, such as Bentonite, are promoted by positively charged promoters such as tetramethyl ammonium hydroxide or chloride or water-soluble complex resinous amine condensation products such as the water-soluble condensation products of diethanolamine and adipic acid, the water-soluble condensation products of ethylene oxide, urea and formaldehyde, and polyethylenimine. Amphoteric materials such as proteinaceous materials like gelatin, glue, casein, albumin, glutin and the like, are effective promoters for a wide variety of colloidal solids. Nonionic materials like methoxycellulose are also effective in some instances. Usually, the promoter need be used only to the extent of a few parts per million of aqueous medium although larger proportions can often be tolerated. In some instances, ionic materials normally classed as emulsifiers, such as soaps, long chain sulfates and sulfonates and the long chain quaternary ammonium compounds, can also be used as promoters for the solid colloids, but care must be taken to avoid causing the formation of stable colloidal emulsions of the polymerizable liquid and the aqueous liquid medium.

An effect similar to that of organic promoters is often obtained with small amounts of electrolytes, e.g., water-soluble, ionizable alkalies, acids and salts, particularly those having polyvalent ions. These are especially useful when the excessive hydrophilic or insufficient oleophilic characteristic of the colloid is attributable to excessive hydration of the colloid structure. For example, a suitably cross-linked sulfonated polymer of styrene is tremendously swollen and hydrated in water. Although the molecular structure contains benzene rings which should confer on the colloid some affinity for the oil phase in the dispersion, the great degree of hydration causes the colloidal particles to be enveloped in a cloud of associated water. The addition of a soluble, ionizable polyvalent cationic compound, such as an aluminum or calcium salt, to the aqueous composition causes extensive shrinking of the swollen colloid with exudation of a part of the associated water and exposure of the organic portion of the colloid particle, thereby making the colloid more oleophilic.

The solid colloidal particles whose hydrophilic-hydrophobic balance is such that the particles tend to gather in the aqueous phase at the oil-water interface, gather on the surface of the oil droplets and function as protective agents in the phenomenon of limited coalescence.

Other agents that can be employed in an already known manner to effect modification of the colloidal properties of the aqueous composition are those materials known in the art as peptizing agents, flocculating and deflocculating agents, sensitizers, surface active agents and the like.

It is sometimes desirable to add to the aqueous liquid a few parts per million of a water-soluble, oil-insoluble inhibitor of polymerization effective to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid is then admixed with the liquid polymerizable material in such a way as to disperse the liquid polymerizable material as small droplets within the aqueous medium. This dispersion can be accomplished by any usual means, e.g., by mechanical stirrers or shakers, by pumping through jets, by impingement, or by other procedures causing subdivision of the polymerizable material into droplets in a continuous aqueous medium.

The degree of dispersion, e.g., by agitation is not critical except that the size of the dispersed liquid droplets must be no larger, and is preferably much smaller, than the stable droplet size expected and desired in the stable dispersion. When such condition has been attained, the resulting dispersion is allowed to rest with only mild, gentle movement, if any, and preferably without agitation. Under such quiescent conditions, the dispersed liquid phase undergoes a limited degree of coalescence.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which can be as large as 0.3 and sometimes 0.5 centimeter in diameter, are quite stable as regards further coalescence and are remarkably uniform in size. If such a large droplet dispersion be vigorously agitated, the droplets are fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying this phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, i.e., on the surface of the oil droplets. It is thought that droplets which are substantially covered by such solid colloid are stable to coalescence while droplets which are not so covered are not stable. In a given dispersion of a polymerizable liquid the total surface area of the droplets is a function of the total volume of the liquid and the diameter of the droplets. Similarly, the total surface area barely coverable by the solid colloid, e.g., in a layer one particle thick, is a function of the amount of the colloid and the dimensions of the particles thereof. In the dispersion as initially prepared, e.g., by agitation, the total surface area of the polymerizable liquid droplets is greater than can be covered by the solid colloid. Under quiescent conditions, the unstable droplets begin to coalesce. The coalescence results in a decrease in the number of oil droplets and a decrease in the total surface area thereof up to a point at which the amount of colloidal solid is barely sufficient substantially to cover the total surface of the oil droplets, whereupon coalescence substantially ceases.

If the solid colloidal particles do not have nearly identical dimensions, the average effective dimension can be estimated by statistical methods. For example, the average effective diameter of spherical particles can be computed as the square root of the average of the squares of the actual diameters of the particles in a representative sample.

It is usually beneficial to treat the uniform droplet suspension prepared as described above to render the suspension stable against congregation of the oil droplets.

This further stabilization is accomplished by gently admixing with the uniform droplet dispersion an agent capable of greatly increasing the viscosity of the aqueous liquid. For this purpose, there may be used any water-soluble or water-dispersible thickening agent that is insoluble in the oil droplets and that does not remove the layer of solid colloidal particles covering the surface of the oil droplets at the oil-water interface. Examples of suitable thickening agents are sulfonated polystyrene (water-dispersible, thickening grade), hydrophilic clays such as Bentonite, digested starch, natural gums, carboxy-substituted cellulose ethers and the like. Often the thickening agent is selected and employed in such quantities as to form a thixotropic gel in which are suspended the uniform-sized droplets of the oil. In other words, the thickened liquid generally should be non-Newtonian in its fluid behavior, i.e., of such a nature as to prevent rapid movement of the dispersed droplets within the aqueous liquid by the action of gravitational force due to the difference in density of the phases. The stress exerted on the surrounding medium by a suspended droplet is not sufficient to cause rapid movement of the droplet within such non-Newtonian media. Usually, the thickener agents are employed in such proportions relative to the aqueous liquid that the apparent viscosity of the thickened aqueous liquid is in the order of at least 500 centipoises (usually determined by means of a Brookfield viscosimeter using the No. 2 spindle at 30 r.p.m.). The thickening agent is preferably prepared as a separate concentrated aqueous composition that is then carefully blended with the oil droplet dispersion.

The resulting thickened dispersion is capable of being handled, e.g., passed through pipes, and can be subjected to polymerization conditions substantially without mechanical change in the size or shape of the dispersed oil droplets.

The resulting dispersions are particularly well suited for use in continuous polymerization procedures that can be carried out in coils, tubes and elongated vessels adapted for continuously introducing the thickened dispersions into one end and for continuously withdrawing the mass of polymer beads from the other end. The polymerization step is also practiced in batch manner.

The order of the addition of the constituents to the polymerization usually is not critical, but beneficially it is more convenient to add to a vessel the water, dispersing agent, and incorporated the oil-soluble catalyst to the monomer mixture, and subsequently add with agitation the monomer phase to the water phase.

The following is an example illustrating a procedure for preparing the cross-linked polymeric microbeads coated with slip agent. In this example, the polymer is polystyrene cross-linked with divinylbenzene. The microbeads have a coating of silica. The microbeads are prepared by a procedure in which monomer droplets containing an initiator are sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX (a colloidal suspension containing 50% silica sold by DuPont. A monomer phase is prepared by combining 3317 g styrene, 1421 g divinylbenzene (55% active cross-linking agent; other 45% is ethyl vinyl benzene which forms part of the styrene polymer chain) and 45 g VAZO 52 (a monomer-soluble initiator sold by DuPont). The mixture is passed through a homogenizer to obtain 5 micron droplets. The suspension is heated overnight at 52° C. to give 4.3 kg of generally spherical microbeads having an average diameter of about 5 microns with narrow size distribution (about 2.10 microns size distribution) The mol proportion of styrene and ethyl vinyl benzene to divinylbenzene is about 6.1%. The concentration of divinylbenzene can be adjusted up or down to result in about 2.5–50% (preferably 10–40%) crosslinking by the active cross-linker. Of course, monomers other than styrene and divinylbenzene can be used in similar suspension polymerization processes known in the art. Also, other initiators and promoters may be used as known in the art. Also, slip agents other than silica may also be used. For example, a number of LUDOX colloidal silicas are available from DuPont. LEPANDIN colloidal alumina is available from Degussa. NALCOAG colloidal silicas are available from Nalco and tin oxide and titanium oxide are also available from Nalco.

Normally, for the polymer to have suitable physical properties such as resiliency, the polymer is cross-linked. In the case of styrene cross-linked with divinylbenzene, the polymer is about 2.5–50% cross-linked, preferably about 20–40% cross-linked. By percent cross-linked, it is meant the mol % of cross-linking agent based on the amount of primary monomer. Such limited cross-linking produces microbeads which are sufficiently coherent to remain intact during orientation of the continuous polymer. Beads of such cross-linking are also resilient, so that when they are deformed (flattened) during orientation by pressure from the matrix polymer on opposite sides of the microbeads, they subsequently resume their normal spherical shape to produce the largest possible voids around the microbeads to thereby produce articles with less density.

The microbeads are referred to herein as having a coating of a "slip agent". By this term it is meant that the friction at the surface of the microbeads is greatly reduced. Actually, it is believed this is caused by the silica acting as miniature ball bearings at the surface. Slip agent may be formed on the surface of the microbeads during their formation by including it in the suspension polymerization mix.

Microbead size is regulated by the ratio of silica to monomer. For example, the following ratios produce the indicated size microbead:

| Microbead Size, Microns | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The microbeads of cross-linked polymer range in size from about 0.1–50 microns, and are present in an amount of about 5–50% by weight based on the weight of the polyester. Microbeads of polystyrene should have a Tg of at least 20° C. higher than the Tg of the continuous matrix polymer and are hard compared to the continuous matrix polymer.

Elasticity and resiliency of the microbeads generally results in increased voiding, and it is preferred to have the Tg of the microbeads as high above that of the matrix polymer as possible to avoid deformation during orientation. It is not believed that there is a practical advantage to cross-linking above the point of resiliency and elasticity of the microbeads.

The microbeads of cross-linked polymer are at least partially bordered by voids. The void space in the shaped article should occupy about 2–60%, preferably about 30–50%, by volume of the shaped article. Depending on the manner in which the shaped articles are made, the voids may completely encircle the microbeads, e.g., a void may be in the shape of a doughnut (or flattened doughnut) encircling a microbead, or the voids may only partially border the microbeads, e.g., a pair of voids may border a microbead on opposite sides.

The microbeads may also be of other materials incompatible with the matrix polymer, such as cellulose esters and starch esters. Cellulose acetates and starch acetates are especially suitable.

Suitable cellulose acetates are those having an acetyl content of about 28 to 44.8% by weight, and a viscosity of about 0.01–90 seconds. Such cellulose acetates are well known in the art. Small contents of propionyl can usually be tolerated. Also, processes for preparing such cellulose acetates are well known in the art. Suitable commercially available cellulose acetates include the following which are marketed by Eastman Chemical Products, Inc.

Suitable starch acetates are those having an acetyl content of about 28 to 44.8% by weight, and a viscosity of about 0.01–90 seconds. Small contents of propionyl can usually be tolerated.

Starch esters are prepared by esterifying starch with acetic acid, or a combination of a major component of acetic acid and minor components of butyric and/or propionic acids, in generally the same way as cellulose esters are prepared. Such processes are well known in the art.

Starch is a polysaccharide which occurs in all green plants; and some well-known sources are wheat, corn, barley, rice, and potatoes. Common starches are a mixture of two polysaccharides — about 20–30 % alphaamylose (a linear polysaccharide) and about 80–70 % betaamylose (a branched polysaccharide often called amylopectin). The basic structural units of these natural polymers contain 3 active hydroxyl groups capable of being "acetylated" or esterified. These structures are given below to clarify the similarities among these materials.

STARCH

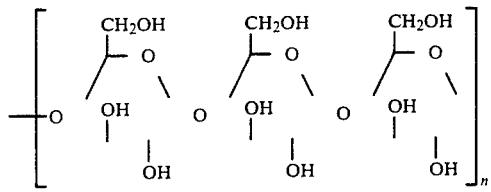

Amylose

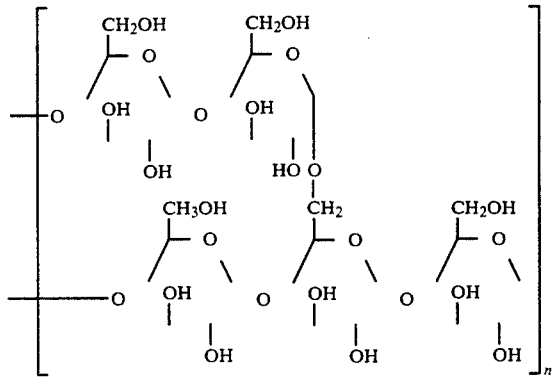

Amylopectin

Wherein n has a value in each of the formulas of between 300 and 500.

The invention does not require but permits the use or addition of a plurality of organic and inorganic materials such as fillers, pigments, antiblocks, anti-stats, plasticizers, dyes, stabilizers, nucleating agents, optical brighteners, etc. These materials may be incorporated into the matrix phases, into the dispersed phases, or may exist as separate dispersed phases.

The voids, or void spaces, referred to herein surrounding the microbeads are formed as the continuous matrix polymer is stretched at a temperature above the Tg of the matrix polymer. The microbeads are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bi-directional stretching), in effect such stretching has vector components extending radially from any given position to result in a doughnut-shaped void surrounding each microbead.

Other ingredients are often added such as surfactants, emulsifiers, pigments, and the like during the preparation of such microbeads. Due to the nature of these additives, they tend to remain on the surfaces of the microbeads. In other words, they tend to accumulate at the interface between the polymer and the immiscible medium in which the suspension polymerization is carried out. However, due to the nature of such processes, some of these materials can remain within the core of the beads and some in the immiscible medium. For example, processing and formulating may be done to entrap ingredients within the beads. In other cases, the goal may be to concentrate ingredients on the surface of the beads. It is this highly diverse and very controllable set of bead properties that adds to the uniqueness of this invention. For the examples involving cross-linked microbeads, the preparation steps are as follows:

(1) The microbeads are prepared by conventional aqueous suspension polymerization to give nearly monodisperse bead diameters from 2 to 20 microns and at levels of cross-linking from 5 mol % to 30 mol %. Almost all of these examples employ coated microbeads, with the coating thickness being about 50–100 nm.

(2) After separation and drying, the microbeads are compounded on conventional twin-screw extrusion equipment into the orientable polymer to a level of 25% by weight and pelletized to form a concentrate, suitable for let-down to lower loadings.

(3) The microbead concentrate pellets are mixed with virgin pellets and dried using standard conditions for polyethylene terephthalate, 170°–180° C. convection with desiccated air for 4–6 hours.

(4) The dried blends are extruded on conventional melt blowing extruders at melt temperatures at about 265°–280° C., standard conditions for the polyethylene terephthalate used, and melt blown as described herein.

The preparation procedure for cellulose acetate microbeads is as follows:

(1) The polyethylene terephthalate pellets are ground through a 2 mm screen and dry-blended with the cellulose acetate powder.

(2) The blends are pan dried in a vacuum oven with dry nitrogen bleed at about 125°–150° C. for 16 hours.

(3) The dried blends are simultaneously extruded and compounded on conventional melt blowing extruders using a standard Maddock mixing section in the metering region of the screw. Melt temperatures are kept as low as possible, about 260°–270° C., to minimize thermal degradation of the cellulose acetate.

(4) During the extrusion, molten CA microbeads form "in situ" by a process of shear emulsification and remain uniformly dispersed due to their high immiscibility with the PET. A distribution of particle diameters is produced ranging from about 0.1–10 microns, with the average being about 1–2 microns.

The materials used in the examples are identified as follows:

PET — polyester having repeat units from terephthalic acid and ethylene glycol; I.V.=0.70

CA — cellulose acetate, viscosity=3.0 seconds, 11.4 poises; acetyl content 39.8%; hydroxyl content=3.5%; melting range=230°–250° C.; Tg=180° C.; number average molecular weight=30,000 (Gel Permeation Chromatography)

PS — polystyrene cross-linked with divinylbenzene to various levels

PMMA — polymethylmethacrylate cross-linked with divinylbenzene to various levels silica — colloidal silica, $SiO_2$, mean particle diameter=20–40 nm alumina — colloidal alumina, $Al_2O_3$, mean particle diameter=20–40 nm The following examples are submitted for a better understanding of the invention.

Example 1

Poly(ethylene terephthalate) of 0.7 I.V. is blended with polystyrene microbeads cross-linked with divinylbenzene. Polystyrene content of these beads is about 70% by weight. Average size of the beads is about 5 microns. Prior to blending, PET is dried at 100° C. under vacuum for about 12 hours. These blends contained 80% PET by weight and 20% by weight of polystyrene microbeads. Pellets were formed from the blended materials. These pellets were dried again at 100° C. under vacuum, and were further processed on a laboratory scale melt-blowing unit equipped with a ¾"diameter extruder with L/D=24 and a metering pump to make melt-blown fibers and structures therefrom. Typical processing conditions (extrusion temperature profile, air flow, air temperature, etc.) are given in Table 1.

The density of the melt-blown fibers was 1.116 g/cc. The fibers are opaque to visible light. Thus, one can form microvoided melt blown fibers into a sheet with unique surface texture and structures therefrom from PET and PS beads cross-linked with divinylbenzene.

Example 2 (Comparative)

Poly(ethylene terephthalate) of 0.7 I.V. is dried at 100° C. under vacuum for 12 hours. It is processed on a laboratory scale melt blowing unit, same as in Example 1. Typical processing conditions are given in Table 1. The density of the melt blown fibers was 1.318. The fiber surface is relatively smooth. It does not contain any "voids".

Example 3

The same material, as in Example 1, was used in this run. Block temperature was reduced to 311° C and air temperature to 340° C. Typical processing conditions are given in Table 1. The fibers have a unique surface texture and do contain microvoids. The density of the melt blown fibers was 1.173.

In Examples 1, 3 and 4 above, the melt blown fibers are first formed into a thermally bonded sheet, and subsequently thermoformed into a useful article such as a tray.

TABLE 1

| Temperature (°C.) | Typical Processing Conditions for Examples | | | | |
|---|---|---|---|---|---|
| | Example 1 | Example 2 (Comparative) | Example 3 | Example 4 | Example 5 (Comparative) |
| $T_1$ (inlet) | 170 | 171 | 170 | 140 | 140 |
| $T_2$ | 246 | 246 | 245 | 176 | 176 |
| $T_3$ | 280 | 280 | 280 | 184 | 184 |
| $T_4$ | 285 | 286 | 282 | 188 | 188 |
| $T_5$ | 310 | 320 | 299 | 207 | 207 |
| $T_6$ | 321 | 331 | 311 | 230 | 230 |
| $T_7$ | 321 | 331 | 311 | 230 | 230 |
| Die Temp. | 301 | 310 | 299 | 259 | 258 |
| Air Temp. | 350 | 350 | 340 | 340 | 340 |
| Air Flow (SCFH) | 22.5 | 22.5 | 22.5 | 22.5 | 22.5 |
| Air Pressure (psig) | 3.5 | 3.5 | 4.0 | 3.1 | 3.1 |
| Die Pressure (psig) | 660 | 405 | 639 | 102 | 90 |
| Extruder Pressure (psig) | 190 | 270 | 190 | 240 | 200 |
| Fiber Density (g/cc) | 1.116 | 1.318 | 1.173 | 0.765 | 0.863 |

Example 4

In this example, polypropylene was used as the matrix polymer, instead of poly(ethylene terephthalate) as in Example 1. Melting point of polypropylene is about 160° C. Thus lower temperatures than PET were used to process this material. A blend of polypropylene (melt flow rate of 62 g/10 min at 190° C. and a load of 2160 g with an orifice of 0.0825"diameter — ASTM D-1238) and polystryrene bead cross-linked with divinyl benzene was prepared in a Brabender extruder. The average size of the polystyrene beads in this case was about 2 microns in diameter. Pellets made from this blend were further processed on a laboratory scale melt-blowing unit equipped with a ¾"diameter extruder having L/D ratio of 24 to make melt blown fibers and structures therefrom. Typical processing conditions are given in Table 1. The density of the melt blown fibers was 0.765 g/cc. The density is significantly reduced as compared to the density of the blended pellets used to melt blow these fibers. The density of the blended pellets was 0.902. The fibers also contain microvoids.

Example 5 (Comparative)

Polypropylene as used in Example 4 was used without blending with micro beads of polystyrene. The processing conditions are given in Table 1. The density of the melt blown fibers was 0.863 g/cc. The fiber surface is relatively smooth. It does not contain any voids. No microvoids are seen in optical micrographs of this fiber.

Examples 1 through 5 clearly indicate the microvoided melt blown fibers and structures therefrom can be obtained from poly(ethylene terephthalate) and polypropylene when they are blended with polystyrene microbeads cross-linked with divinyl benzene. In practice, this invention is not limited to only these polymers, but includes all other materials that can be melt blown.

Glass transition temperatures, Tg and melt temperatures, Tm, are determined using a Perkin-Elmer DSC-2 Differential Scanning Calorimeter.

Unless otherwise specified inherent viscosity is measured in a 60/40 parts by weight solution of phenol/tetrachloroethane 25° C. and at a concentration of about 0.5 gram of polymer in 100 ml of the solvent.

Where acids are specified herein in the formation of the polyesters or copolyesters, it should be understood that ester forming derivatives of the acids may be used rather than the acids themselves as is conventional practice. For example, dimethyl isophthalate may be used rather than isophthalic acid.

Unless otherwise specified, all parts, ratios, percentages, etc. are by weight.

The invention has been described in detail with particular reference to preferred embodiments thereof, but it will be understood that variations and modifications can be effected within the spirit and scope of the invention.

We claim:

1. A molded article comprising a melt blown assembly of thermally bonded, longitudinally oriented fibers, said fibers comprising a continuous polymer matrix having dispersed therein microbeads of a material which is incompatible with said polymer matrix which are at least partially bordered by void space, said microbeads being present in an amount of about 5–50% by weight based on the weight of polymer matrix, said void space occupying about 2–60% by volume of said fibers.

2. The article of claim 1 wherein said continuous polymer matrix comprises a member selected from the group consisting of polyesters and polyolefins.

3. The article of claim 1 wherein said microbeads comprise a member selected from the group consisting of cellulose esters, starch esters, and cross-linked polymers.

4. A thermoformed article according to claim 1.

5. The article of claim 1 wherein said continuous polymer matrix comprises at least one polyester or polyolefin and said microbeads comprise at least one cellulose ester, starch ester or cross-linked polymer.

6. The article of claim 1 wherein said continuous polymer matrix is polyethylene terephthalate.

7. The article of claim 1 wherein said microbeads comprise a cross-linked polymer.

8. The article according to claim 1 wherein said microbeads comprise a cross-linked polymer of a polymerizable organic material which is a member selected from the group consisting of an alkenyl aromatic compound having the general formula

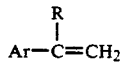

wherein Ar represents an aromatic hydrocarbon radical, or an aromatic halohydrocarbon radical of the benzene series and R is hydrogen or the methyl radical; acrylate-type monomers including monomers of the formula

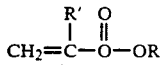

wherein R is selected from the group consisting of hydrogen and an alkyl radical containing from about 1 to 12 carbon atoms and R′ is selected from the group consisting of hydrogen and methyl; copolymers of vinyl chloride and vinylidene chloride, acrylonitrile and vinyl chloride, vinyl bromide, vinyl esters having the formula

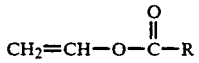

wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$, wherein n is a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

9. The article according to claim 1 wherein said microbeads are formed in the presence of a slip agent.

10. The article according to claim 9 wherein said slip agent is silica or alumina.

* * * * *